US006691831B1

(12) United States Patent
Furuya

(10) Patent No.: US 6,691,831 B1
(45) Date of Patent: Feb. 17, 2004

(54) SPLASHING OIL LUBRICATION TYPE INTERNAL COMBUSTION ENGINE

(75) Inventor: Akira Furuya, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/672,250

(22) Filed: Sep. 28, 2000

(30) Foreign Application Priority Data

Sep. 29, 1999 (JP) ..... 11-275645

(51) Int. Cl.[7] ..... F01M 5/00

(52) U.S. Cl. ..... 184/104.2; 184/106; 165/51; 123/196 AB

(58) Field of Search ..... 184/13.1, 104.1, 184/104.2, 104.3, 106; 123/196 AB; 165/185, 41, 51; F01M 13/06; F16N 7/26, 7/28

(56) References Cited

U.S. PATENT DOCUMENTS 1,365,438 A * 1/1921 Adamson ..... 184/104.3
1,583,099 A * 5/1926 Rayfield ..... 184/13.1
1,950,034 A * 3/1934 Mulford et al. ..... 475/160
2,577,188 A * 12/1951 Hall ..... 184/106
2,706,469 A * 4/1955 Nallinger ..... 123/196 AB
2,862,656 A * 12/1958 Kadison ..... 417/243
3,487,818 A * 1/1970 Dineen ..... 123/197.4
3,817,354 A * 6/1974 Meiners ..... 184/104.3
5,333,575 A * 8/1994 Olmr ..... 123/41.42
5,755,194 A * 5/1998 Moorman et al. ..... 123/196 W
6,039,020 A * 3/2000 Kawamoto et al. .... 123/196 M

FOREIGN PATENT DOCUMENTS

EP 481584 A1 * 4/1992 ..... F16H/57/04
JP 8177441 7/1996
JP 10280932 10/1998

* cited by examiner

*Primary Examiner*—David Fenstermacher
(74) *Attorney, Agent, or Firm*—Martin A. Farber

(57) ABSTRACT

A plurality of heat receiving ribs are projected inwardly from the inner wall surfaces of a crankcase of a splashing oil lubrication type internal combustion engine. The heat receiving ribs extend in the same direction of a crankshaft so as to easily absorb heat from splashed engine oil. As a result, the temperature in the crankcase is reduced, thereby the lubrication characteristic of the engine oil can be maintained in good condition.

4 Claims, 4 Drawing Sheets

SPLASHING OIL LUBRICATION TYPE INTERNAL COMBUSTION ENGINE

BACKGROUND OF THE INVENTION

1. Field of the Invention

The present invention relates to a splashing oil lubrication type internal combustion engine and more particularly to a splashing oil lubrication type internal combustion engine capable of reducing temperature of engine oil by raising a cooling efficiency of a crankcase.

2. Background Art

An example of the splashing oil lubrication type internal combustion engine disclosed in Japanese Patent Application Laid-open No. Toku-Kai-Hei 10-280932 has a method of splashing oil stored below in a crankcase by an oil dipper equipped with a connecting rod and another example of the engine disclosed in Japanese Patent Application Laid-open No. Toku-Kai-Hei 8-177441 has a method of splashing oil by an oil dipper rotating in an interlocking relationship with a crankshaft.

FIG. 4 is a front sectional view of a splashing oil lubrication type engine according to the prior art. An engine 1 has a cylinder block 2 integrally formed with a crankcase 4 and including a cylinder 3. The crank case 4 comprises a bottom section 11, a rear wall section 12 extending upwardly from the rear (back side of the drawing) end of the bottom section 11, side wall sections 13, 14 extending upwardly from the left and right end of the bottom section 11 respectively and connecting with the left and right ends of the rear wall section 12 respectively, a ceiling section 15 closing upper ends of the rear wall section 12, the side wall sections 13, 14, and a crank chamber 16 enclosed by these bottom section 11, side wall sections 13, 14, ceiling section 15 and a crank case cover (not shown) formed on the front side of the crank case 4.

A crank shaft 18 extending in an orthogonal direction with respect to the drawing is rotatably supported at the rear end thereof by a bearing 18 formed at a specified vertical position of the rear wall section 12 and supported at the front end thereof by a bearing (not shown) provided at the same vertical position of the crank case cover. A crank pulley 19 is coaxially secured to the front end of the crankshaft 18. The crank pulley 19 has teeth on the periphery surface thereof to mesh with teeth of a timing belt 26 wound around the crank pulley 19 and a camshaft pulley 25 which will be described hereinafter.

The cylinder 3 of the cylinder block 2 has a cylinder axis 5 slanted with respect to the vertical direction of the engine 1 so that the axis 5 extends above diagonally from the upper portion of the right wall section 14 of the crankcase 4. The cylinder 3 is connected at the upper end thereof with a cylinder head 21 having a valve train mechanism 22. Further, at the front of the cylinder 3, there is provided a belt chamber 23 communicating between the crank chamber 16 and a valve train chamber of the cylinder head 21. The valve train mechanism 22 has a camshaft 24 extending in the same direction as the crankshaft 18. The camshaft pulley 25 is coaxially secured to the front end of the camshaft 24 and has teeth meshing with the teeth of the timing belt 26.

The timing belt 26 is constituted by fabric core material such as carcass, lubber and synthetic resin and has equally spaced step-like teeth formed on the inner periphery surface of the belt. Further, the timing belt 26 is housed in the belt chamber 23 and wound around the crank pulley 19 and the cam pulley 25 so as to rotate the cam shaft 24 in an interlocking relationship with the rotation of the crankshaft 18.

However, the engine according to the prior art as described above is not designed so as to reduce temperature inside of the crank chamber 16 or to reduce temperature of engine oil splashed in the crank chamber 16 or engine oil stored in the lower part of the crank chamber 16. Accordingly, in case where temperature of the crank chamber 16 becomes high, temperature of engine oil is also increased and as a result its lubrication characteristic goes down.

Further, there is a fear that splashed engine oil in high temperature sticks to the timing belt 26 and as a result heat deteriorates the timing belt 26.

SUMMARY OF THE INVENTION

It is an object of the present invention to provide a splashing oil lubrication type internal combustion engine capable of reducing temperature of the crank chamber 16 and lowering the temperature of engine oil. Particularly, as well known, the lowering of engine oil is very important for maintain the lubrication characteristic of engine oil in good condition, that is, for preventing the lubrication performance for lubricating miscellaneous components, such as a crankshaft, a connecting rod, intake and exhaust valves and a valve driving mechanism, from being degraded. It is another object of the present invention to provide a splashing oil lubrication type internal combustion engine in which a timing belt of the engine can be protected from deterioration due to heat received from engine oil.

In accordance with a first aspect of the invention, the object is achieved by absorbing heat in a crank chamber as much as possible. For that purpose, the engine comprises an oil splashing means for splashing engine oil in the crank chamber in a radial direction of a crankshaft and for forming a flow of splashing oil around the crankshaft and a plurality of heat receiving ribs projected inwardly from the inner wall surface of the crankcase so as to absorb heat in the crank chamber.

A second aspect of the present invention is to provide an engine capable of discharging heat the crankcase as much as possible. For that purpose, the engine includes a plurality of heat radiating ribs projected outwardly from the outer wall surface of the crankcase so as to discharge heat in the crank chamber out of the engine.

Further, a third aspect of the present invention is to provide heat receiving ribs on the inner wall surface of the crankcase and at the same time to provide heat radiating ribs on the outer wall surface of the crankcase so as to further enhance the heat discharge from the crankcase.

DESCRIPTION OF PRFERRED EMBPDIMENTS

Figure 1:
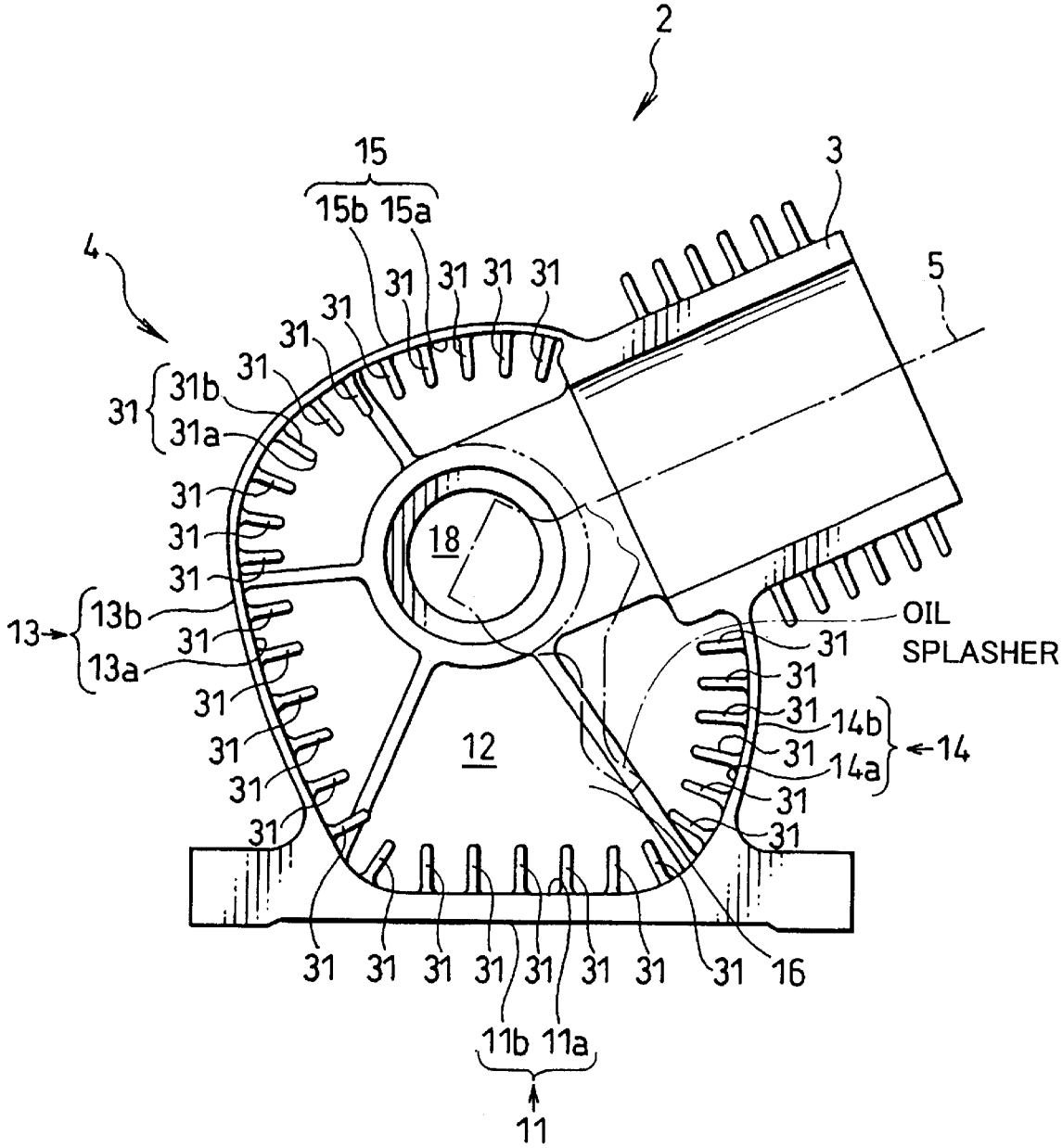
FIG. 1 is an elevational, longitudinal, sectional, view showing a cylinder block of an engine according to a first embodiment.

Referring now to FIG. 1, the feature of the crank chamber 16 according to this embodiment is to provide heat receiving ribs 31 projected from the inner surface of the wall of the crank case 4.

The heat receiving ribs 31, as shown in FIG. 1, are projected inwardly perpendicularly to the inner surfaces 11*a*, 13*a*, 14*a* and 15*a* of the bottom section 11, side wall sections 13, 14 and the ceiling section 15 respectively and extended in the same direction (perpendicular direction to the drawing) as the crankshaft 18 with a certain height retained. Further, the heat receiving ribs 31 are provided around the crankshaft 18 at a certain interval.

The configuration of the heat receiving ribs 31 is established such that the top of the rib 31 does not contact moving parts such as the crankshaft 18 and a connecting rod (not shown) in the crank chamber 16. The heat receiving ribs 31 are formed to be thin at the top portion of the rib and to be thick at a base portion 31*b* of the rib. Further, the base portion 31*b* of the rib is formed so as to smoothly connect with the inner surfaces 11*a*, 13*a*, 14*a* and 15*a*.

The thickness of the heat receiving rib 31 and the interval between two adjacent ribs are established respectively so as to efficiently absorb heat in the crank chamber 16.

Thus constituted heat receiving ribs absorb heat from splashed engine oil in the crank chamber 16 and positively reduce the temperature in the crank chamber 16.

As a result, the temperature of engine oil stored in the lower part of the crank chamber 16 or engine oil splashed in the crank chamber 16 can be reduced, thereby the lubrication characteristic of engine oil can be maintained in a proper condition and components of the engine can be lubricated properly.

Figure 4:
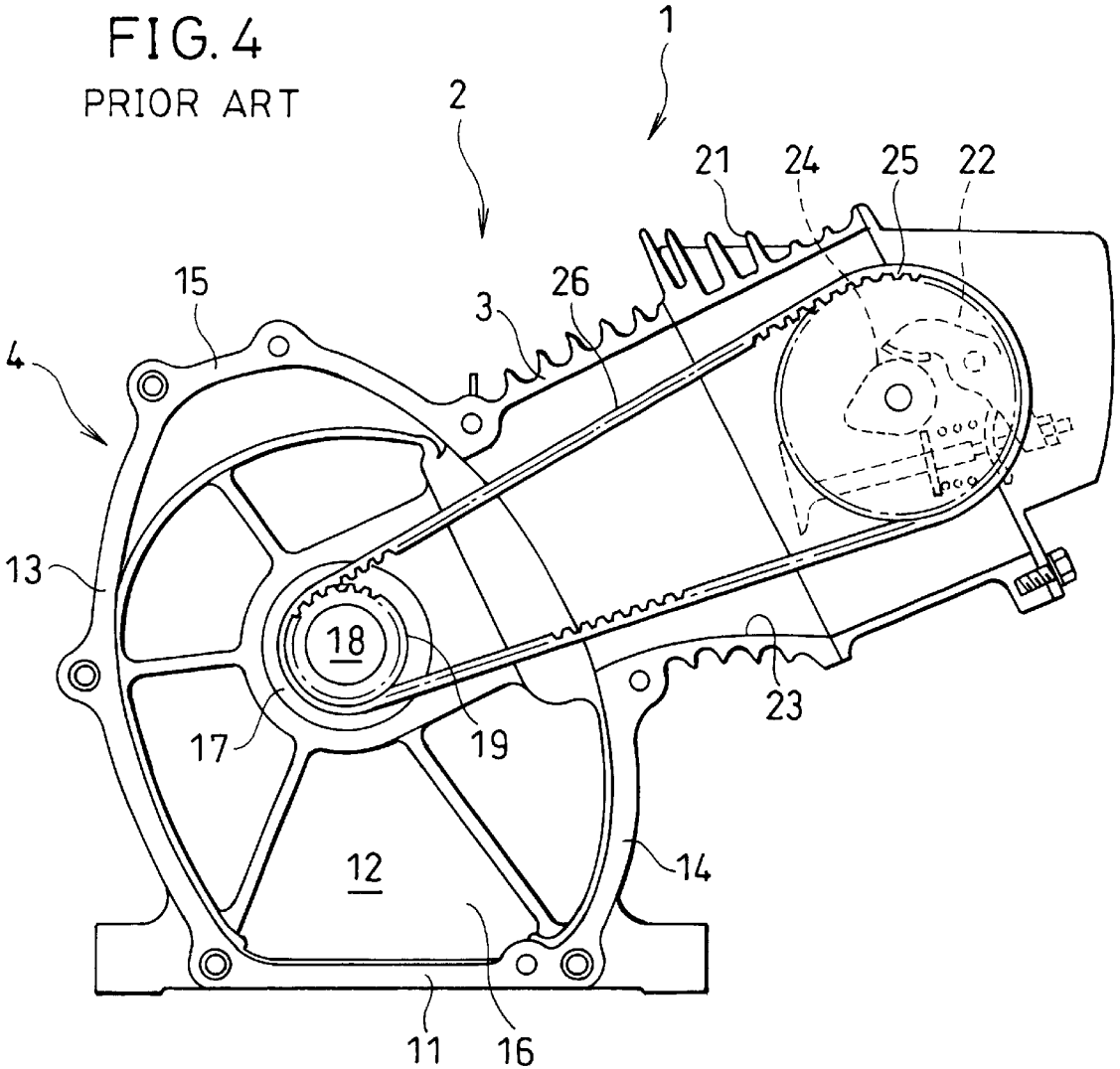
FIG. 4 PRIOR ART
FIG. 4 is an elevational, longitudinal, sectional, view showing a cylinder block of an engine according to a prior art.

Further, since the temperature of splashed engine oil is reduced due to the lowered temperature of the crank chamber, the timing belt 26 can be prevented from being deteriorated due to the adherence of splashed engine oil in high temperature to the timing belt 26 (see FIG. 4). This largely contributes to an improvement of endurance and a long life of the timing belt 26.

The engine 1 according to the embodiment has a dipper (not shown) projected from a large end (not shown) of a connecting rod (not shown) supported by the crankshaft 18. The dipper is for forming a flow of splashing oil in the crank chamber 16 by agitating and splashing engine oil stored in the lower part of the crank chamber 16 in an orthogonal direction of the crankshaft 18.

The heat receiving ribs 31 extend in the same direction as the crankshaft 18 and therefore the splashed oil abuts against the overall surface of the heat receiving ribs 18 in the orthogonal direction. As a result, the heat receiving ribs 31 can absorb heat effectively from the splashed oil, thereby the temperature in the crank chamber 16 can be reduced more efficiently.

Further, the crankcase 4 having a plurality of the heat receiving ribs 31 increases its rigidity, this permitting the walls of the crankcase 4 to be thinner. The thinner walls are advantageous in further reducing the weight of the engine 1.

Next, a second embodiment of the present invention will be described by reference to FIG. 2. The feature of the crank chamber 16 according to this embodiment is to provide heat radiating ribs 32 projected from the outer surface of the wall of the crankcase 4.

Figure 2:
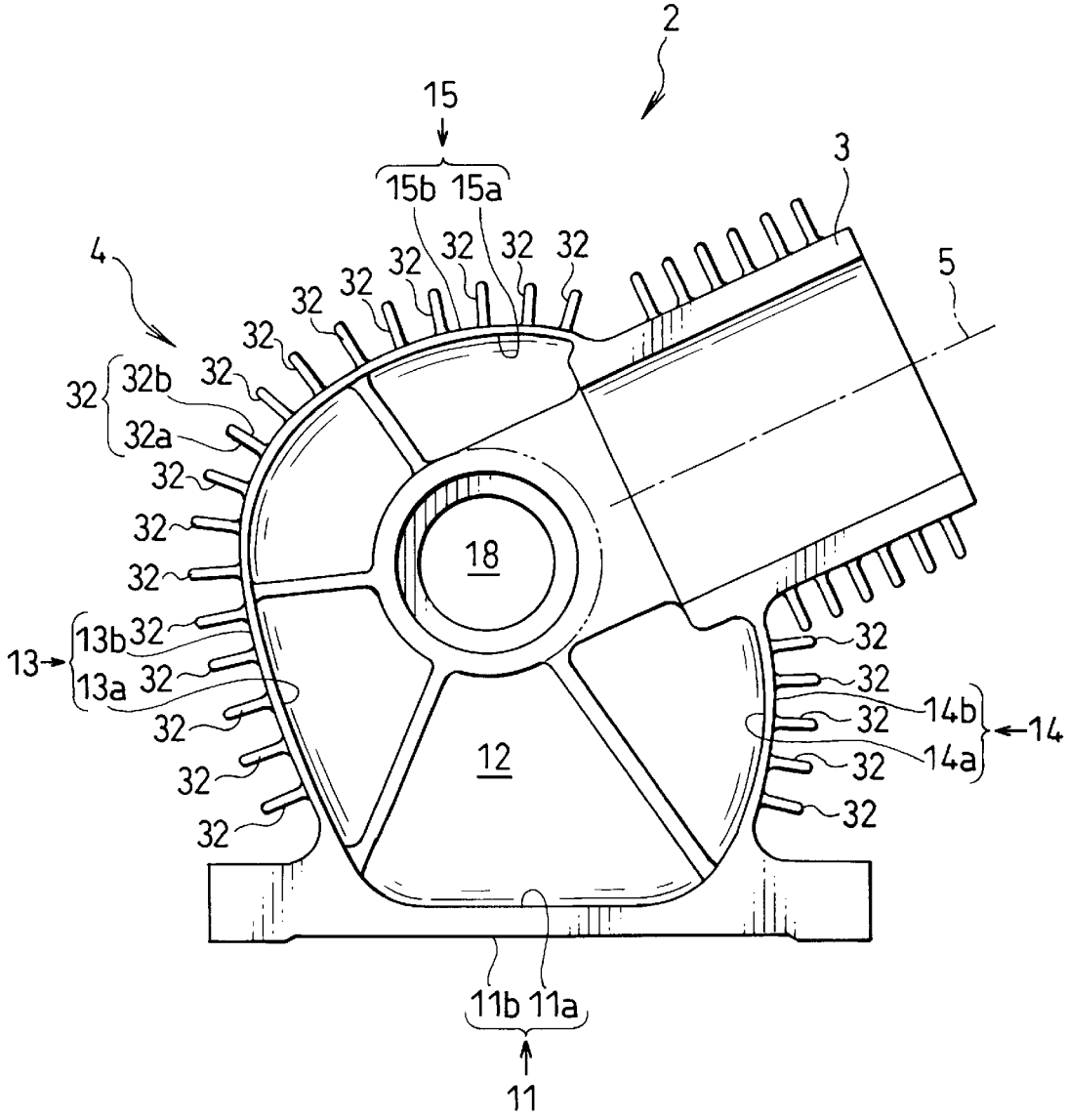
FIG. 2 is an elevational, longitudinal, sectional, view showing a cylinder block of an engine according to a second embodiment.

The heat radiating ribs 32, as shown in FIG. 2, are projected outwardly perpendicularly to the outer surfaces 13*b*, 14*b* and 15*b* of the side wall sections 13, 14 and the ceiling section 15 respectively and extended in the same direction (perpendicular direction to the drawing) as the crankshaft 18 with a certain height retained. Further, the heat radiating ribs 32 are provided around the crankshaft 18 at a certain interval.

The heat radiating ribs 32 are formed to be thin at the top portion 32*a* thereof and to be thick at a base portion 32*b* thereof. Further, the base portion 31*b* of the rib is formed so as to smoothly connect with the outer surfaces 13*b*, 14*b* and 15*b*.

The thickness of the heat radiating ribs 32 and the interval between two adjacent ribs are established respectively so as to efficiently radiate heat of the crankcase 4.

An engine having thus constituted cylinder block 2 can discharge heat of the crankcase 4 out of the engine 1 by means of the heat radiating ribs 32 and positively reduce the temperature in the crank chamber 16.

As a result, the temperature of engine oil stored in the lower part of the crank chamber 16 or engine oil splashed in the crank chamber 16 can be reduced, thereby the lubrication characteristic of engine oil can be maintained in a proper condition and components of the engine can be lubricated properly. Further, the temperature descent of the crank chamber 16 can prevent deterioration of the timing belt 26.

Further, a plurality of heat radiating ribs 32 provided on the outer surfaces 13*b*, 14*b* and 15*b* of the crankcase 4 enhance the rigidity of the crankcase 4 and as a result the walls of the crankcase 4 can be established to be thinner, thereby the weight of the engine 1 can be reduced.

Figure 3:
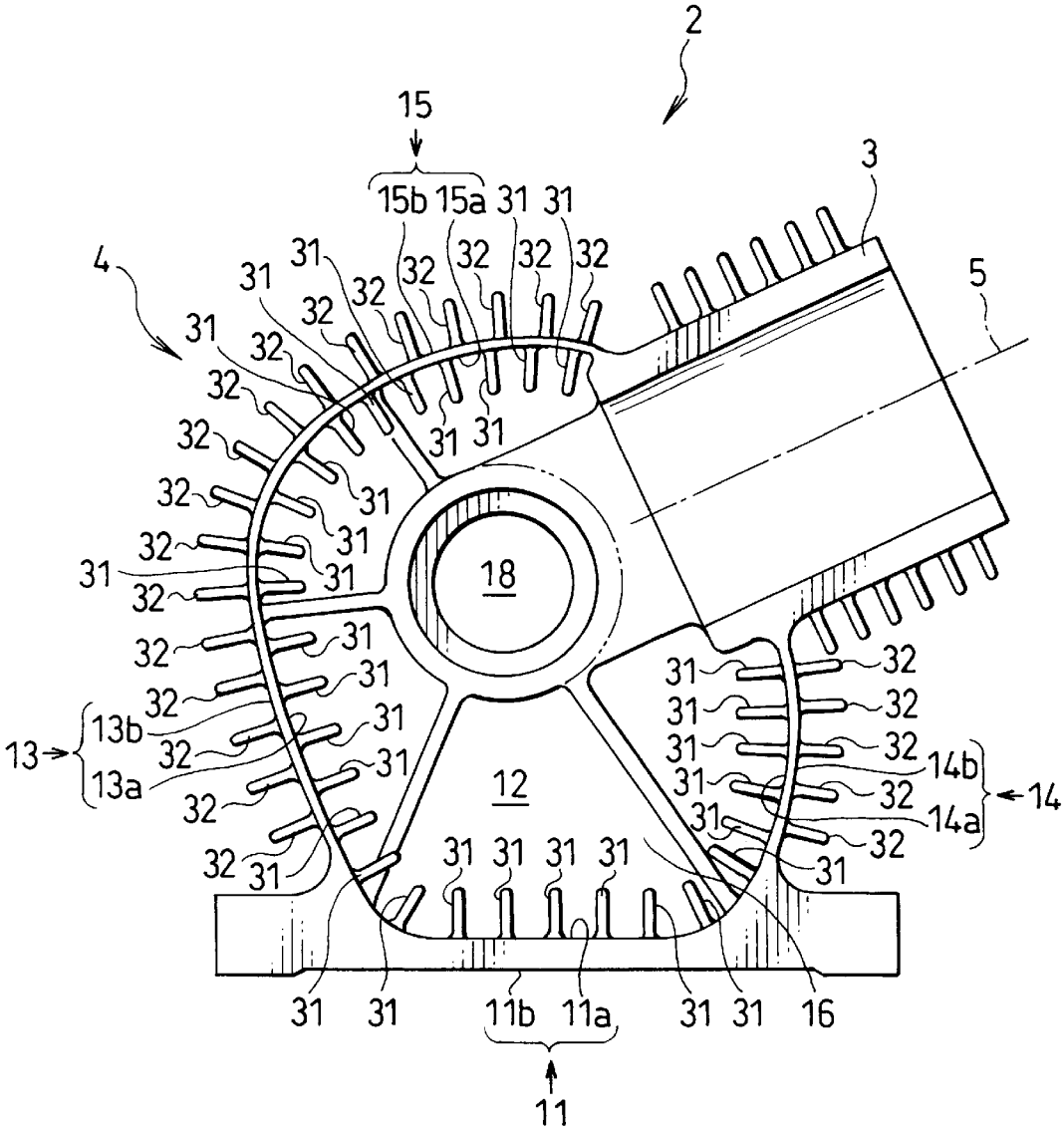
FIG. 3 is an elevational, longitudinal, sectional, view showing a cylinder block of an engine according to a third embodiment.

Next, a third embodiment of the present invention will be described by reference to FIG. 3. The feature of the crank chamber 16 according to this embodiment is to provide heat receiving ribs 31 projected from the inner surfaces 11*a*, 13*a*, 14*a* and 15*a* of the wall of the crankcase 4 and further heat radiating ribs 32 projected from the outer surfaces 13*b*, 14*b* and 15*b* of the wall.

According to this embodiment, the heat receiving ribs 31 absorb heat in the crank chamber 16 and the heat radiating ribs 32 discharge heat of the crankcase 4. As a result, the temperature descent of the crank chamber 16 can be further improved. Accordingly, it is possible to maintain the lubrication characteristic of engine oil in good condition and to prevent deterioration of the timing belt 26 due to heat.

The present invention is not limited to the embodiments described hereinbefore and various modifications can be available within the scopes of the present invention. For example, in the first and third embodiments, the heat receiving ribs 31 are provided in the bottom section 11, the side wall sections 13, 14 and the ceiling section 15 respectively. However, the heat receiving ribs 31 are not necessary to be provided in all of these wall sections. For example, the heat receiving ribs 31 in the bottom section 11 can be omitted.

A place where the heat receiving ribs 31 are to be disposed can be chosen anywhere, if it is a place where temperature of the crank chamber 16 can be efficiently reduced. Further, the heat receiving ribs 31 may be disposed partially in the crank chamber 16.

Further, the heat receiving ribs 31 or heat radiating ribs 32 may be disposed on the inner or outer surface of the rear wall section 12 or the front wall section (not shown).

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. A splashing oil lubrication engine having a crankcase including a bottom section, side wall sections and a ceiling section, a crankshaft, a crank chamber enclosed by the crankcase, an engine oil, stored in the crankcase, and an oil splashing means for splashing the engine oil in the crank chamber in a radial direction of the crankshaft and for forming a flow of splashing oil around the crankshaft; comprising:

a plurality of heat receiving fins projected inwardly from inner wall surfaces of said bottom section, at least one of said side wall sections, and said ceiling section of said crankcase, all sections of which form a surface parallel to said crankshaft, to absorb heat of said engine oil in said crank chamber, said fins being spaced away from said bearing housings provided around the crankshaft.

2. The engine according to claim 1, wherein said heat receiving fins extend in an orthogonal direction of said flow of splashing oil.

3. A splashing oil lubrication engine having a crankcase, a crankshaft, a crank chamber enclosed by the crankcase and serving for the storage of oil, and an oil splashing means for splashing the oil in the crank chamber in a radial direction of the crankshaft and for forming a flow of splashing oil around the crankshaft, the crankcase including a bottom section, sidewall section, sidewall sections, a ceiling section and bearing housings; the engine further comprising:

an array of heat receiving ribs arranged serially along inner wall surfaces of said bottom section, at least one of said side wall sections and said ceiling section of said crankcase, all sections of which form a surface parallel to said crankshaft, to absorb heat of said engine in said crank chamber, each of said fins projecting inwardly from one of said inner wall surfaces only part way towards said crankshaft to permit formation of a flow of splashing oil around the crankshaft, said fins being spaced away from said bearing housings provided around the crankshaft.

4. A splashing oil lubrication engine having a crankcase including a bottom section, side wall sections, a ceiling section and bearing housings, a crankshaft, a crank chamber enclosed by the crankcase, an engine oil stored in the crankcase, and an oil splashing means for splashing the engine oil in the crank chamber in a radial direction of the crankshaft and for forming a flow of splashing oil around the crankshaft; comprising:

a plurality of heat receiving fins projected inwardly from inner wall surfaces of said bottom section, at least one of said side wall sections, and said ceiling section of said crankcase, all sections of which form a surface parallel to said crankshaft, to absorb heat in said crank chamber, said fins being spaced away from said bearing housings provided around the crankshaft; and a plurality of heat radiating fins projected outwardly from outer wall surfaces of said bottom section, at least one of said side wall sections, and said ceiling section of said crankcase to discharge said absorbed heat in said crank case.

* * * * *